United States Patent [19]

Peebles

[11] Patent Number: 4,720,895

[45] Date of Patent: Jan. 26, 1988

[54] QUICK-DISCONNECT DOOR HINGE

[75] Inventor: Russell H. Peebles, Grosse Pointe Park, Mich.

[73] Assignee: Chrysler Motors Corporation, Highland Park, Mich.

[21] Appl. No.: 918,219

[22] Filed: Oct. 14, 1986

[51] Int. Cl.[4] ..... E05D 7/10; E05D 11/10; E05D 5/00

[52] U.S. Cl. ..... 16/264; 16/248; 16/332; 16/344; 16/382; 16/389

[58] Field of Search ..... 16/255, 264, 266, 270, 16/272, 293, 296, 297, 308, 321, 334, 335, 344, 347, 354, 387, 389, DIG. 29, 239, 243, 245, 248, 332, 382; 296/146

[56] References Cited

U.S. PATENT DOCUMENTS

| | | | |
|---|---|---|---|
| 1,419,479 | 6/1922 | Webber | 16/270 |
| 3,729,772 | 5/1973 | Marchione | 16/82 |
| 3,870,361 | 3/1975 | Krause | 16/248 |
| 4,285,098 | 8/1981 | Hicks | 16/308 |
| 4,532,675 | 8/1985 | Salazar | 16/335 |

FOREIGN PATENT DOCUMENTS

| | | | |
|---|---|---|---|
| 2406438 | 8/1975 | Fed. Rep. of Germany | 16/245 |

*Primary Examiner*—Nicholas P. Godici
*Assistant Examiner*—Edward Brown
*Attorney, Agent, or Firm*—Edward P. Barthel

[57] ABSTRACT

An improved automotive vehicle door hinge assembly enabling the vehicle doors to be quickly removed and reassembled during the assembly line advancement of the vehicle body. The hinge body half comprises a main member and a U-shaped extension member. The main member includes a flat mounting plate portion and a channel shaped angled portion bent outwardly from the plate portion. The U-shaped extension member has a planar base portion provided with right angled side flanges defining a pair of parallel legs each terminating in a hinge knuckle. The main member angled portion is sized for snug nested reception of the U-shaped extension member. An aperture is provided in the extension member base wall aligned with an aperture in the main member channel shaped portion bight wall. Upon tightening a threaded bolt in the aligned apertures the juxtaposed surfaces of the members are adapted for mutual clamped abutment preventing both separation and relative rotation thereof.

5 Claims, 6 Drawing Figures

QUICK-DISCONNECT DOOR HINGE

BACKGROUND OF THE INVENTION

This invention relates generally to automobile door hinges and, more specifically, to a quick disconnect hinge for the door.

Hold-open hinges for vehicle doors are well known in the prior art. An example of a torsion bar hold-open hinge is shown in U.S. Pat. Nos. 3,729,772 and 3,870,361 issued to Marchione and Krause, respectively. The Marchione hinge includes an outer or door half of a cage type hinge to which an inner or body half is pivotally connected by means of a pintle pin. The outer and inner hinge members are both stamped sheet metal construction, with the outer and inner member each having bolt holes provided therein for reception of bolts for fastening to a door and the vehicle body, respectively. Both members are generally channel shaped. The inner body half includes a flat mounting portion for abuttingly engaging a portion of the vehicle body and upstanding bracket portions for mounting the pintle pin.

Another example of a prior art vehicle hinge is shown in U.S. Pat. No. 4,532,675 issued Aug. 6, 1986 to Salazar. The Salazar patent disclosed a leaf spring type of hold-open vehicle door hinge assembly comprising a body plate and a door plate pivotally interconnected through a pintle pin. The Marchione, Krause and Salazar devices disclose conventional two piece vehicle door hinges which require numerous disassembly operations to enable a door to be removed from the vehicle during an assembly line operation thereby allowing the doors to be trimmed away from the body.

SUMMARY OF THE INVENTION

It is therefore an object of the present invention to provide an improved vehicle door hinge enabling the doors to be quickly removed and reassembled during the assembly line advancement of the vehicle body thereby allowing the interior of the removed doors to be more conveniently equipped and trimmed while supported on a suitable fixture.

To this end, according to the present invention, the body half of the hinge is formed in two readily separable pieces, i.e., a body half main member and a body half U-shaped extension member. The body half main member includes a conventional channel shaped flat mounting plate portion for abuttingly engaging the vehicle body door opening pillar. In the improved quick disconnect hinge, one end of the body half main member is bent outwardly from the plate portion to define an angled portion.

The extension member has a planar base portion provided with a pair of extended side flanges in the form of parallel outstanding legs each terminating in a hinge knuckle. The main member channel shaped angled portion is sized for snug nested reception of the U-shaped extension. The U-shaped extension base portion has an aperture that is readily aligned with an aperture in the main member channel shaped bight wall. Upon tightening a threaded bolt in the aligned apertures the members juxtaposed surfaces are shaped for mutual clamped abutment preventing separation or relative rotation of the members about the axis of the bolt. By virtue of holding the door upper and lower hinge pintle pins in proper relation to each other the precise original door mounting location is maintained upon remounting the door.

DESCRIPTION OF THE DRAWINGS

These and other features, objects and advantages of the invention will become apparent upon consideration of the specification and appended claims in which:

DESCRIPTION OF THE PREFERRED EMBODIMENT

Figure 1:
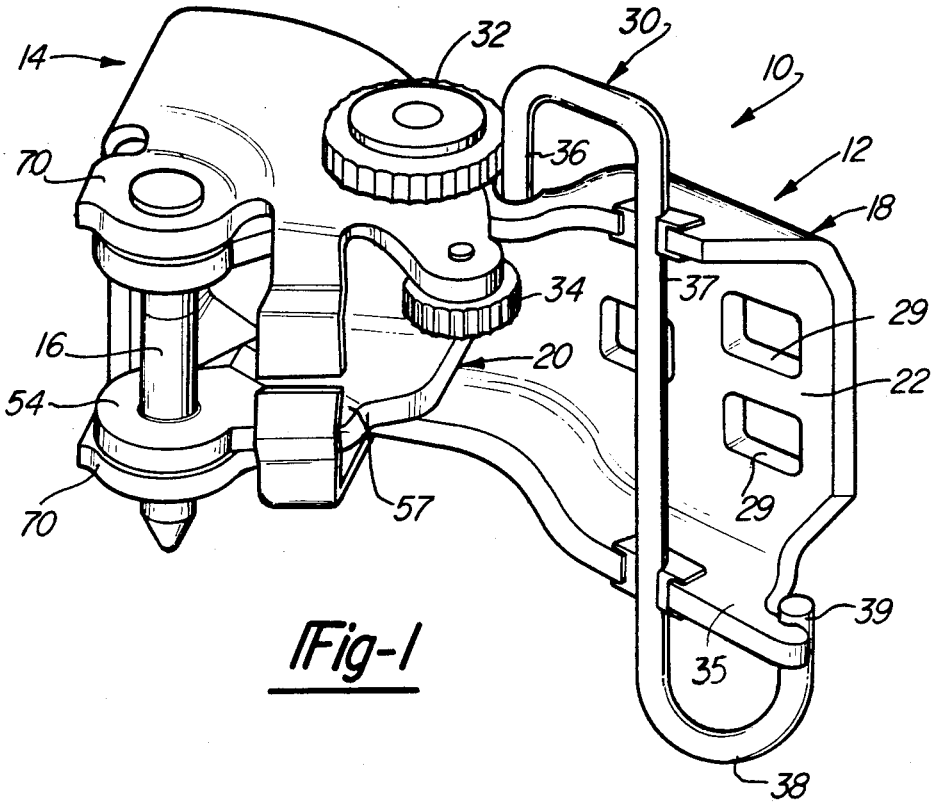
FIG. 1 is a perspective view of the hinge of the present invention in the door intermediate check position.

Referring now to the drawings and in particular to FIG. 1 thereof, a hinge assembly 10 is illustrated comprising a body half 12 and a door half 14 pivotally interconnected through a pintle pin 16. The body half 12, as best seen in FIGS. 2 and 5, includes a body half main member 18 and a body half extension or bracket member 20.

Figure 2:
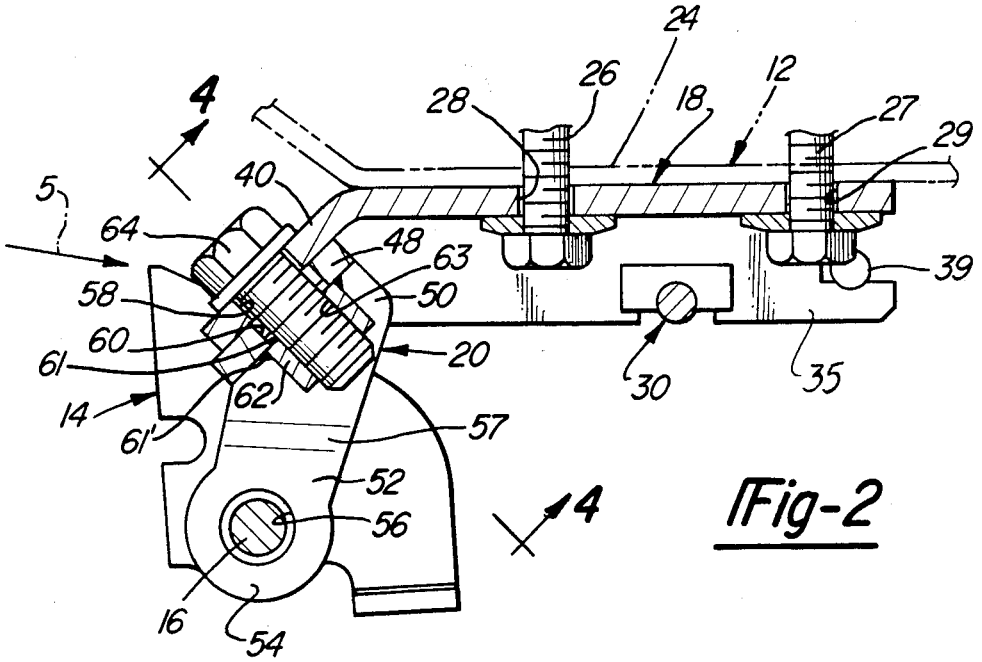
FIG. 2 is a horizontal sectional view of the hinge of FIG. 1 installed on a vehicle in the door closed position.

The main member 18 comprises a channel shaped flat mounting portion 22 for abuttingly engaging of the vehicle body door opening pillar, partially indicated in phantom lines at 24 in FIG. 2. Attachment of the mounting plate portion 22 to the vehicle body pillar 24 is preferably made by conventional fasteners such as indicated at 26 and 27 located in mounting portion apertures 28 and 29, respectively.

As best seen in FIG. 1, a torsion bar 30 is mounted in preloaded condition on the body half 12 of the hinge for hold-open purposes. The hold-open feature of the hinge 10 is not part of the present invention and is disclosed in the above-mentioned U.S. Pat. Nos. 3,729,772 and 3,870,361. Two spaced scalloped detent rollers 32 and 34 are shown to which a deflectable portion 36, parallel to main portion 37 of the torsion bar 30, is movable in the door opening and closing movements. Upon the roller 32 deflecting portion 36 the door is held releasably in its intermediate check or partial open position of FIG. 1. Deflection of the portion 36 by roller 34 places the door in its full open or second check position. The torsion bar 30 has a lower radius arm 38 that is bent upwardly and has a free end 39 abutting a mounting portion flange 35. For a detailed description of the hold-open feature, reference may be had to the aforesaid patents, the disclosures of which are incorporated by reference herein.

Figure 5:
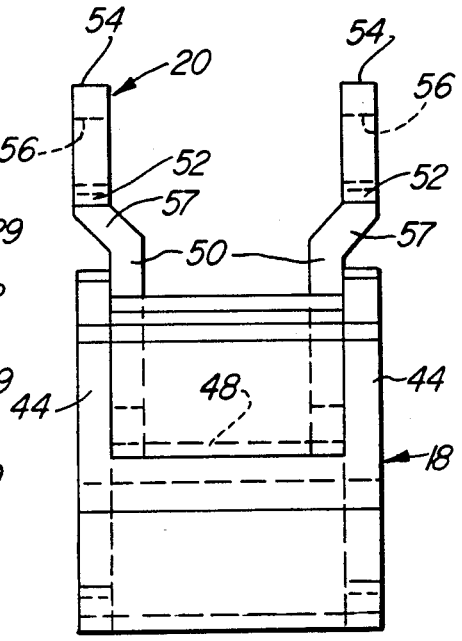
FIG. 5 is a detail view of the hinge inner body half main and extension bracket members only taken in the direction of arrow 5 in FIG. 2.
Figure 6:
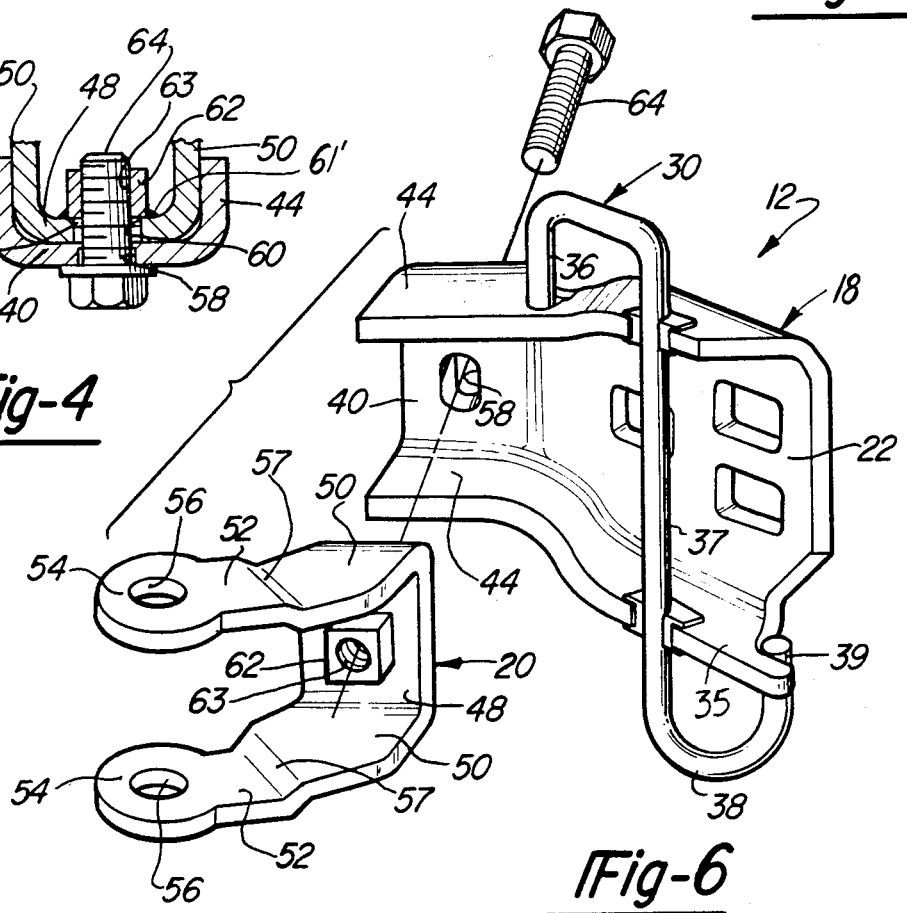
FIG. 6 is an exploded perspective view of the hinge body half main and extension members.

Turning now to FIGS. 2 and 5, the body half main member 18 includes the channel shaped mounting plate portion 22 and an outwardly bent angled portion. As seen in FIG. 6, the angled portion is channel shaped in cross section defined by a planar bight wall 40 and a pair of right angled side flanges 44.

The body half U-shaped extension member 20 is in the form of a planar base wall 48 having right angled flanges in the form of parallel legs 50 projecting outwardly therefrom. Each leg 50 includes an intermediate oblique portion 52 terminating in a hinge knuckle 54.

Figure 3:
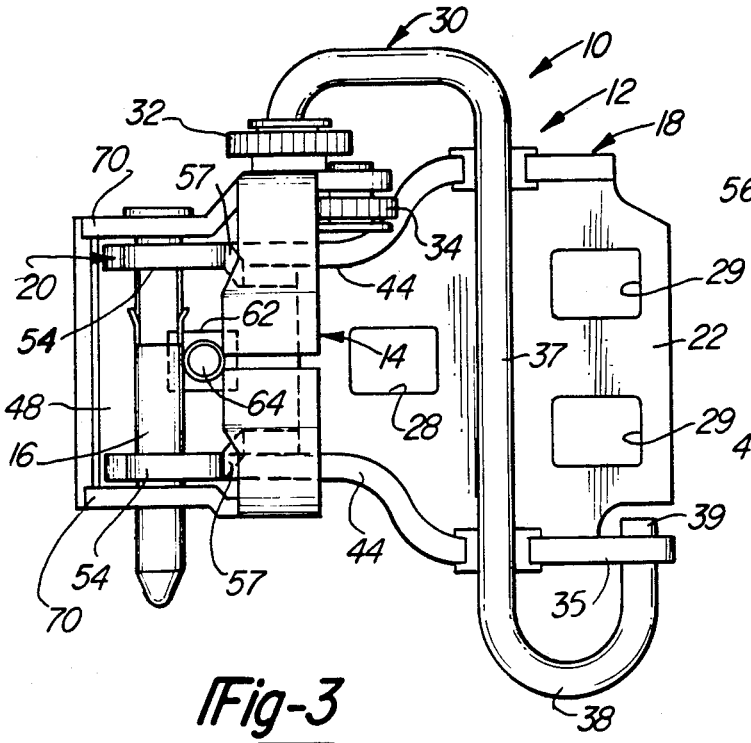
FIG. 3 is a side elevational view of the hinge of FIG. 1.

The knuckles have aligned holes 56 for the reception of pintle pin 16. It will be noted that the oblique portions 52 are outwardly offset from the legs 50 by crimp portions 57. As seen in FIGS. 3 and 5, this construction locates the knuckles 54 in coplanar alignment with the angled portion side flanges 44.

Figure 4:
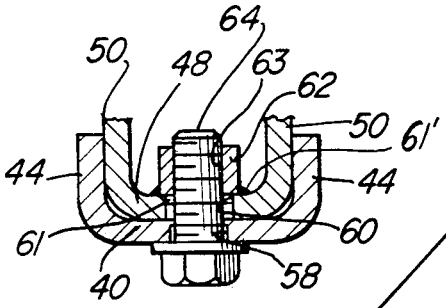
FIG. 4 is a vertical sectional view taken substantially on the line 4—4 of FIG. 2.

As seen in FIGS. 4 and 5, the bight wall 40 has an aperture in the form of a slot 58 formed transversely to the centerline of the main member. The slot 58, which has its major axis extending normal to the flanges 44, is aligned with a through hole 60 in the extension member planar base wall 48. A weld nut 62 has a cylindrical pilot portion 61 inserted in the hole 60 and welded at 61' to the inner surface of planar base 48. Thus, the weld nut threaded bore 63 is in coaxial alignment with the slot 58 major axis for the threaded reception of a threaded machine bolt 64. It will be seen in FIG. 4 that the channel shaped bight wall 40 and side flanges 44 of the body half main member are sized to receive the planar base 48 and legs 50 of the U-shaped extension member 20 in a juxtaposed nested abutting manner. Thus, upon the machine bolt 64 being tightly threaded into the weld nut 62, the body half, main and extension members are positively locked together in a precise manner obviating any separation or relative rotation about the axis of the bolt 64. The slot 58 allows for any tolerance variation with the threaded bore 63 upon nesting the members 18 and 20.

In operation, the vehicle body is advanced along an assembly line with the doors attached by upper and lower hinge assemblies 10. The adjacent edges, surfaces and feature lines of the body and door are thus initially precisely aligned and spaced relative to one another. Assembly line workers then may, upon opening the door and removing the single machine bolt 64 on each upper and lower hinge, quickly detach the door from the body. The door then may be placed on a suitable fixture allowing the door interior to be remotely equipped and trimmed.

To reattach the door, it is only necessary to nest each U-shaped extension member 20, which is pinned to its respective hinge door half 14, with its associated upper and lower body half main member 18. Upon threadably tightening the machine bolts 64 in place the members 18 and 20 contiguous faces are held in clamped abutment. It will thus be appreciated that each improved quick-disconnect hinge assembly 20 may be detached and reassembled by the removal and replacement of a single threaded bolt. Further, the snug nested relationship between the main and U-shaped extension hinge members assures ready alignment of their respective slot 58 and threaded bore 63 further minimizing the time required to reattach the door. The main member 18 has its angled portion bight wall 40 bent outwardly from the plane of the mounting plate portion 22 at a predetermined angle of about 45 degrees so as to provide unobstructed access to the head of bolt 64.

In the initial installation of each hinge, the door half 14 of the hinge has its knuckles 70 assembled on the body half U-shaped extension member knuckles 54 and the pintle pin 16 driven into place through the registering holes in the cooperating knuckle portions 70 and 54. Thereafter, the hinge of the present invention can be readily disconnected and reassembled without removing the pintle pin 16 ensuring that the door remains precisely aligned and spaced relative to adjacent outer surfaces of the body.

Although only one embodiment of the invention has been disclosed and described, it is apparent that other embodiments and modifications of the invention are possible.

I claim:

1. In an improved quick disconnect and connect hinge assembly of the type having a body half adopted to be secured to the body of a vehicle and a door half pivotally connected by a pintle pin about a vertical hinge axis to the body half, the improvement wherein:

said body half comprises a main member adapted to be secured to said vehicle body and a U-shaped extension member pivotally connected by said pintle pin to said door half;

said body half main member having a mounting portion adapted to abut the vehicle body and a channel shaped portion including a bight wall and a pair of side flanges extending normal thereto;

said body half U-shaped extension member having a planar base wall and a pair of right angled side flanges, said base wall side flanges in the form of parallel legs projecting outwardly therefrom, each said leg terminating in a knuckle having a hole for the reception of said pintle pin, said body half main member channel-shaped portion sized to receive said body half U-shaped extension member in a juxtaposed nested manner, and aligned aperture means in said extension member base wall and main member bight wall adapted to receive a single fastener therethrough such that said main member and said extension member are positively clamped together by said single fastener thereby obviating both separable and relative rotational movement between said members.

2. The improved hinge assembly as set forth in claim 1, wherein main member having a planar plate mounting portion adapted to abut the vehicle body and said channel shaped portion angled outwardly from said plate mounting portion, and said fastener in the form of a headed machine bolt with said bolt having its head adapted to contact the inboard face of the angled portion bight wall, thereby providing unobstructed access to the head of said bolt.

3. The improved hinge assembly as set forth in claim 2, wherein said aperture means in said main member is in the form of an elongated slot having its major axis normal to said flanges, and said aperture means in said extension member channel shaped portion defining a threaded bore, whereby said slot providing tolerance for the reception of said bolt in said bore.

4. The improved hinge assembly as set forth in claim 3, wherein said main member channel shaped portion is bent at an angle of about 45 degrees from the plane of said plate mounting portion.

5. The improved hinge assembly as set forth in claim 1, wherein each said extension member leg includes an intermediate oblique portion terminating in a knuckle, each said oblique portion being outwardly offset in a direction parallel to said pintle pin axis by a crimp portion whereby each said knuckle is located in coplanar alignment with its associated angled channel shaped side flange.

* * * * *